US007948467B2

(12) United States Patent
Chang et al.

(10) Patent No.: US 7,948,467 B2
(45) Date of Patent: May 24, 2011

(54) GATE DRIVER STRUCTURE OF TFT-LCD DISPLAY

(75) Inventors: Ya-Hui Chang, Hsinchu county (TW); Sung-Yau Yeh, Hsinchu county (TW); Ji-zoo Lin, Hsinchu county (TW)

(73) Assignee: Novatek Microelectronics Corp., Hsinchu (TW)

( * ) Notice: Subject to any disclaimer, the term of this patent is extended or adjusted under 35 U.S.C. 154(b) by 952 days.

(21) Appl. No.: 11/819,082

(22) Filed: Jun. 25, 2007

(65) Prior Publication Data

US 2008/0158204 A1 Jul. 3, 2008

(30) Foreign Application Priority Data

Dec. 29, 2006 (TW) ..... 95149933 A

(51) Int. Cl.
*G09G 3/36* (2006.01)
*G11C 19/00* (2006.01)

(52) U.S. Cl. ..... 345/100; 345/204; 377/64

(58) Field of Classification Search ..... 345/98, 345/100, 204; 377/64, 70, 75, 77
See application file for complete search history.

(56) References Cited

U.S. PATENT DOCUMENTS 4,775,861 A 10/1988 Saito
5,248,963 A 9/1993 Yasui et al.
5,592,191 A 1/1997 Tsuboyama et al.
5,646,571 A * 7/1997 Ohashi ..... 327/390
5,793,346 A 8/1998 Moon
5,828,429 A 10/1998 Takemura
6,005,541 A 12/1999 Takahashi et al.
6,151,016 A 11/2000 Kanbe et al.
6,262,704 B1 7/2001 Kurumisawa et al.
6,426,914 B1 * 7/2002 Dennard et al. ..... 365/230.06
6,639,590 B2 10/2003 Takahashi et al.
7,050,036 B2 * 5/2006 Kim et al. ..... 345/100
7,196,547 B2 * 3/2007 Kozawa ..... 326/81
7,209,132 B2 4/2007 Kida et al.
2003/0053321 A1 * 3/2003 Ishiyama ..... 363/59
2003/0179032 A1 * 9/2003 Kaneko et al. ..... 327/333
2005/0012734 A1 1/2005 Johnson et al.

* cited by examiner

*Primary Examiner* — Stephen G Sherman
(74) *Attorney, Agent, or Firm* — Jianq Chyun IP Office

(57) ABSTRACT

A gate driver structure of TFT-LCD display, comprising: a plurality of first level shifters, each input terminal of which being connected with an input signal; a plurality of output buffers with a plurality of output terminals, each input terminal of the output buffers being connected with each output terminal of the first level shifters; a second level shifter, the input terminal of which being connected with a low voltage signal and the first output terminal of which being connected with a plurality of first level shifters. In addition, the connecting wires between each output terminal of the plurality of first level shifters and each input terminal of the plurality of output buffers are in parallel with a pair of first MOS and second MOS daisy-chained together. The gate of each first MOS is connected with the output terminal of output buffer of the previous cell, and the gate of each second MOS is connected with the second output terminal of the second level shifter.

13 Claims, 9 Drawing Sheets

GATE DRIVER STRUCTURE OF TFT-LCD DISPLAY

FIELD OF THE INVENTION

The present invention is related to a control circuit of TFT-LCD display, and more particularly, to a gate driver circuit structure of TFT-LCD display with XAO function.

BACKGROUND OF THE INVENTION

FIG. 1 is a system block diagram of a TFT-LCD display 10, which comprises a LCD panel 11, a source driver (or data driver) 13, a gate driver (or scan driver) 12, a timing control circuit 14, and a backlight module 15. The light source of LCD panel 11 is provided by the backlight module 15 and LCD panel 11 is driven by the source driver 13 and gate driver 12 which control images displayed. The timing control circuit 14 mainly produces timing control signals in order to control the action of source driver 13 and gate driver 12. In addition, since several sets of power supply are needed by the internal circuits, DC-DC converter can be used to produce several sets of power supply to be provided for other circuits.

In FIG. 2 is an equivalent circuit of TFT-LCD panel. As shown in FIG. 2, each sub-pixel on TFT-LCD panel 11 is mainly composed of TFT 16, liquid crystal 161, and storage capacitor ($C_S$) 162. TFT 16 functions as a switch that switches open in order from top to bottom when the gate driver 12 scans each scan line in order, as shown in FIG. 3; when a whole row of TFTs 16 switch open, the data voltage is written by the source driver 13. The $C_S$ 162 and the liquid crystal 161 are in parallel in order to increase capacitance for maintaining the voltage of data. Therefore, the gate driver 12 is mainly used to drive the drive circuit of the gate array of LCD panel 11.

In a high-resolution TFT-LCD display, for instance, a basic display unit, or a pixel, needs three points to display three primary colors of RGB. For example, when a 3000*2400 resolution TFT-LCD display scans, waveform sent by gate driver 12 switches open TFT 16 on each line in order, and the whole array of source driver 13 then charges the whole line of display points until the voltage needed by each point is achieved to display different gray level. When the charging of one line is finished, the gate driver 12 of this line switches off the voltage, and the gate driver 12 of the next line switches on the voltage and the same row of source driver 13 charges the next line of display points. This process proceeds from one line to the next in order. When the last line of display points are charged, the charging of the first line is restarted and thus achieves the effect of displaying. The main function of gate driver 12 is thus to charge LCD panel 11 to the highest voltage or to discharge to the lowest voltage.

Since the gate driver 12 has to drive all the gates of TFT 16 on each row of TFT-LCD panel 11, thus the TFT-LCD panel 11 is itself a big load. And since gates of TFT 16 on LCD panel 11 are driven by high voltage, which means that high voltage is used to drive gates of TFT 16. The structure of a basic gate driver, as shown in FIG. 4, is composed of a shift register 120, a logic control circuit 121, a level shifter 122, and an output buffer 124. When the data to be displayed is output by the controller (not shown in the diagram), the shift register 120 reads sequentially the data to be displayed to decide the order and arrangement to drive the data. The arranged driving data is sent to the logic control circuit 121 and sent serially to the level shifter 122. Each TFT 16 on LCD panel 11 is then driven at high speed and high voltage by the level-shifted driving data through the output buffer 124. Moreover, since the whole operation of the gate driver circuit is driven by digital circuit, the shift register 120 is thus composed of a plurality of D Flip-Flops; and since the main focus of the output point is high driving power at high speed, therefore the output buffer 124 is composed of a plurality of inverters.

In addition, in order to solve the problem of image-retention effect of TFT-LCD, the technique of XAO function (power off control) is mostly used at present. XAO function means that XAO is set to low level when the display is turned off. For example, the logic low level is set to 0~3.3 v, and thus all outputs of the gate driver will be shifted to high level at the same time and all TFT 16 will be turned on. The charge stored on the CS 162 can thus be discharged and the image-retention effect can be eliminated. However, the common method of using XAO function is to send XAO signal into logic control circuit 121 and to convert low level to high level output through level shifter 122. After the display is turned off, much charge on the capacitor will be discharged since the voltage of power supply is maintained only by the capacitor and all TFT at low level will function at the same time. Therefore, when the pulse of XAO reaches, the gate voltage of all TFT 16 are all shifted to Vgh, and thus a large current is produced at the moment in which the gate of TFT 16 on gate driver circuit is activated. This large current may cause the trace on gate driver circuit to burn. Furthermore, VDD voltage will also decrease rapidly and thus causes the conversion of the level shifter 122 to fail and the XAO function to lose efficacy.

SUMMARY OF THE INVENTION

In the prior art, the way to solve the problem of image-retention effect of TFT-LCD is to set the voltage of XAO to low level and cause all outputs of gate driver to be shifted to high level at the same time so that all TFTs can be turned on and the charge in Cs will be discharged. However, to turn on all TFTs on the gate driver at the same time will cause a large current and may lead to the burning of the trace. In order to eliminate this problem, the design of the present invention can decrease the current of Vgh due to turn on TFTs at the same moment and thus can prevent the trace from burning. Moreover, in the present invention, logic conversion is processed at high voltage level, not from low voltage to high voltage, and the possibility of failed conversion of the level shifter is thus avoided.

Concerning the defect of the traditional gate driver mentioned above, one main object of the present invention is to provide a gate driver circuit of TFT-LCD display to prevent the trace from being burned by a large current when XAO function is activated.

Another main object of the present invention is to provide a gate driver circuit of TFT-LCD display to maintain the XAO function at high voltage level control to prevent VDD being pulled down and the deactivation of XAO.

According to the objects described above, the present invention first provides a gate driver of TFT-LCD display, comprising: a shift register connected to input buffer, a plurality of first level shifters, each input terminal of which being connected with the shift register; a plurality of output buffers, each input terminal of which being connected with each output terminal of the first level shifters and forming a plurality of output cells and the input terminal of each output buffer being further connected with the output terminals of the previous cell of the plurality of output buffers; and a second level shifter, one input terminal of which being connected with a low voltage signal, the first output terminal of which being connected with each of the plurality of first level shifters, and the second output terminal of which being connected with the input terminal of each output buffer.

The present invention then provides a gate driver circuit structure of TFT-LCD display, comprising: a plurality of first level shifters, each input terminal of which being connected with an input signal; a plurality of output buffers with a plurality of output terminals, each input terminal of which being connected with each output terminal of first level shifters; and a second level shifter, the input terminal of which being connected with a low voltage signal and the first output terminal of which being connected with a plurality of first level shifters. In addition, the connecting wires between each output terminal of the plurality of first level shifters and each input terminal of the plurality of output buffers are in parallel with a pair of first MOS and second MOS daisy-chained together. The gate of each first MOS is connected with the output terminal of output buffer of the previous cell, and the gate of each second MOS is connected with the second output terminal of the second level shifter.

The present invention then provides a gate driver circuit structure of TFT-LCD display, comprising: a plurality of first level shifters, each input terminal of which being connected with an input signal; a plurality of output buffers with a plurality of output terminals, each input terminal of which being connected with each output terminal of first level shifters; and a second level shifter, the input terminal of which being connected with a low voltage signal and the first output terminal of which being connected with a plurality of first level shifters. In addition, the connecting wires between each output terminal of the plurality of first level shifters and each input terminal of the plurality of output buffers are in parallel with a pair of first CMOS and second CMOS daisy-chained together. The gate of each first CMOS is connected with the output terminal of output buffer of the previous cell, and the gate of each second CMOS is connected with the second output terminal and the third output terminal of the second level shifter.

The present invention further provides a gate driver circuit structure of TFT-LCD display, comprising: a plurality of first level shifters, each input terminal of which being connected with an input signal; a plurality of output buffers with a plurality of output terminals, each output buffer being composed of a PMOS and an NMOS daisy-chained together. The gate of each PMOS is connected with the output terminal of a first inverter and the input terminal of the first inverter is connected with the output terminal of a compensating circuit. Whereas the input terminal of the first inverter is further connected with a first output terminal of the first level shifter, and the gate of each first NMOS is connected with the second output terminal of the first level shifter and a second NMOS. The gate driver circuit structure further comprises a second level shifter, the input terminal of which being connected with a low voltage signal, the first output terminal of which being connected with a plurality of first level shifters, and the second output terminal of which being connected with a plurality of second NMOS.

DETAILED DESCRIPTION OF THE PREFERRED EMBODIMENTS

The present invention here explores a gate driver circuit structure of TFT-LCD display. The structure will be described in detail in the following description in order to make the present invention thoroughly understood. Preferred embodiments will be described in detail in the following. However, in addition to these preferred embodiments, the present invention can also be applied expansively in other embodiments and the scope of the present invention is not limited and only determined by the appended claims.

Figure 5:
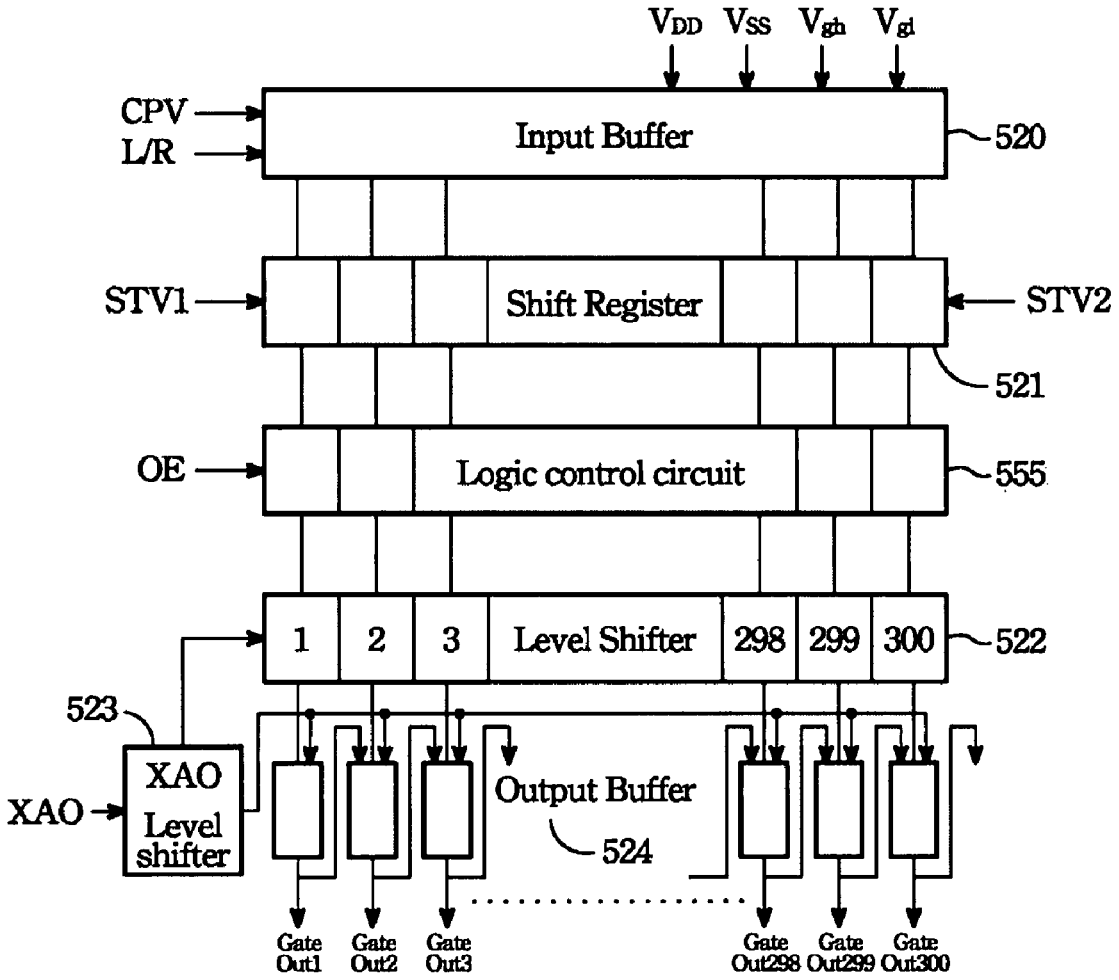
FIG. 5 is a structure diagram of the gate driver of the present invention.

First, please refer to FIG. 5, which is a structure diagram of the gate driver of the present invention. The gate driver comprises input buffer 520, shift register 521, logic control circuit 555, a plurality of first level shifters 522, second level shifter 523, and a plurality of output buffers 524. The process is similar. When the data to be displayed is output by the controller (not shown in the diagram) and transmitted through input buffer 520, the shift register 521 reads sequentially the data to be scanned from a plurality of input terminals according to STV to decide the order and arrangement to drive the data. The arranged driving data is sent to the logic control circuit 121 from a plurality of output terminals and then sent serially to the corresponding plurality of first level shifter 522. The voltage of scan signal is thus increased. The gate of each TFT 16 on LCD panel 11 is then driven at high speed by the plurality of level-shifted scan driving data transmitted through output buffer 524. Moreover, in order to solve the problem of image-retention effect of traditional TFT-LCD, XAO signal is connected with second level shifter 523 in the present invention. Therefore, when XAO signal reaches and is sent through second level shifter 523, not only the XAO signal is level-shifted to high voltage, but the positive feedback loop of first level shifter 522 is also turned off, which causes the output terminal of first level shifter 522 to become floating. At the same time, the output terminals of second level shifter 523 are connected with a plurality of output buffers 524 respectively. In addition, the plurality of output cells formed by the plurality of output buffers 524 in the present invention are fed back to the output buffer 524 of the next cell. Thus, the output signals of the next cell are pulled to high voltage only when the output signals of the output buffers 524 of the previous cell are pulled to high voltage, and each output signal of output buffers 524 is level-shifted to high voltage in order. Therefore the defect that all output signals of output buffers 524 will be level-shifted to high voltage at the same time and a large current will be produced which may lead to the burning of the trace when XAO function is activated can be eliminated. And since XAO is only controlled in high-voltage circuit, VDD will not be pulled down and the efficacy of XAO can be maintained. In the following description, actual circuit will be used for illustration.

Figure 6:
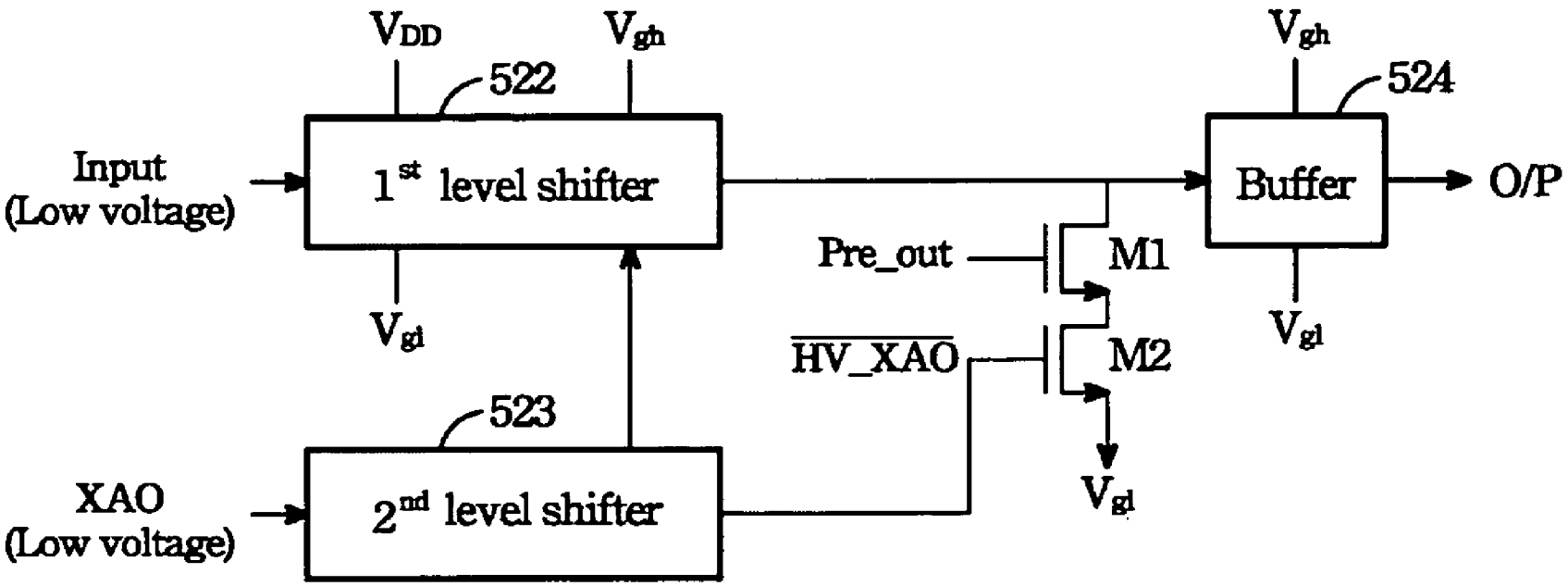
FIG. 6 is a diagram of a basic unit of the gate driver circuit of the present invention.
Figure 7:
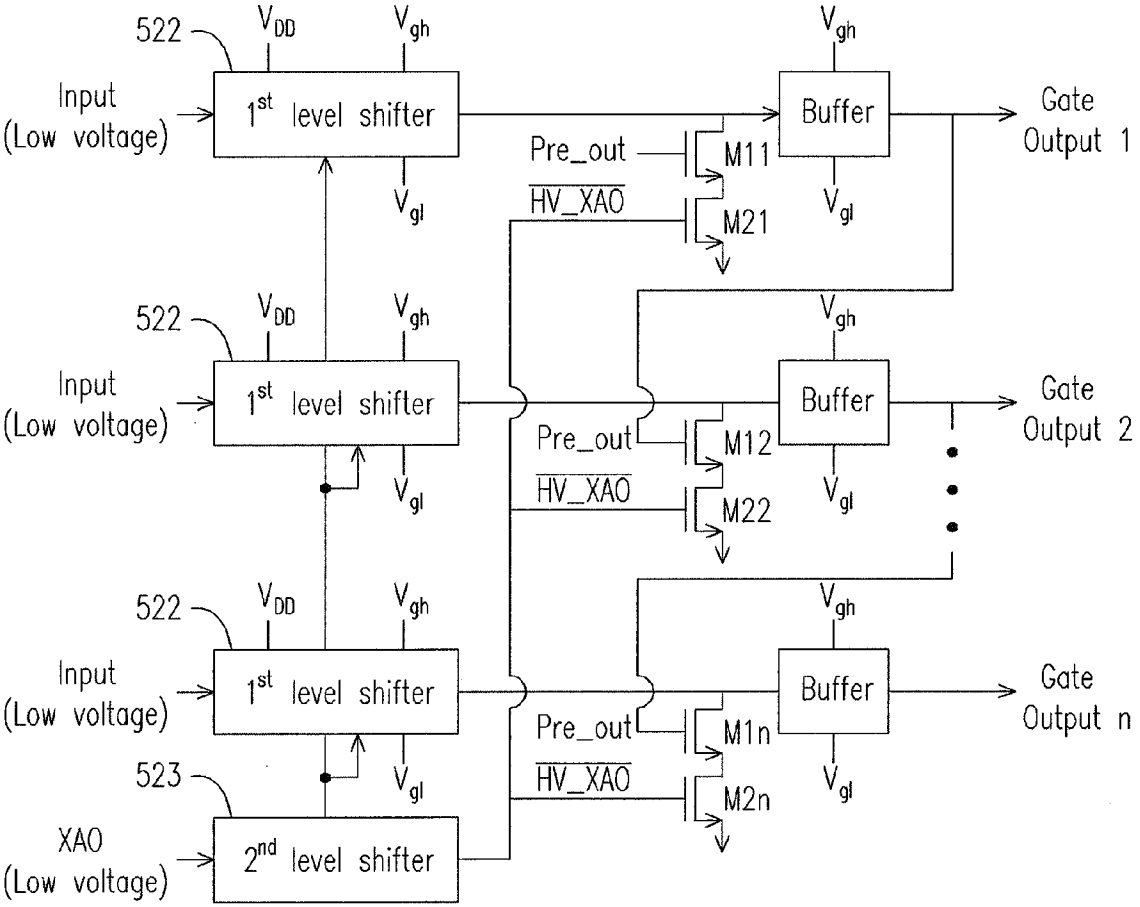
FIG. 7 is a diagram of a preferred embodiment of the gate driver circuit of the present invention.

Then please refer to FIG. 6 and FIG. 7, which are diagrams of the gate driver circuit of the present invention. FIG. 6 shows a basic unit of the gate driver circuit of the present invention. FIG. 7 is a diagram of the circuit of an embodiment.

As shown in FIG. 6, the basic unit of the gate driver circuit of the present invention comprises a first level shifter 522, an output buffer 524, a second level shifter 523, and two MOS, M1 and M2. These two MOS, M1 and M2, can be NMOS or PMOS; for example, when both M1 and M2 are NMOS, the gates of the two MOS, M1 and M2, are connected with the Pre_out signal and the inverse HV_XAO. In a normal process, the first level shifter 522 receives a low voltage signal from shift register 521 and level-shifts the low voltage signal to high voltage condition, which includes Vgh, +25V for example, and Vgl, −15V for example. This high voltage signal is then transmitted to output buffer 524 and at this moment the two MOS, M1 and M2, are not turned on. When XAO signal reaches, it passes through second level shifter 523, which level-shifts the XAO signal to high voltage on the one hand and turns off the positive feedback circuit of first level shifter 522 on the other and thus causes the output terminal of first level shifter 522 to become floating. Since the gate of MOS M2 and the Vgh of second level shifter 523 are connected, the MOS M2 is now ready to turn on. Accordingly, when the gate of MOS M1 is a high voltage signal, MOS M1 and M2 can both be turned on and the input signal of output buffer 524 can be pulled to high voltage low level Vgl, which can then be transferred to Vgh by output buffer 524 and fed back to the gate of MOS M1 of the next cell.

What should be emphasized here is that FIG. 6 shows the structure and operation of a basic unit of the gate driver circuit of the present invention, and FIG. 7 shows its actual circuit in detail. In addition, two level shifters in series can also be used in first level shifter 522 to gradually shift the low voltage signal to high voltage signal, the operation of which is part of a previous technique and will not be described in detail here.

Please then refer to FIG. 7, which shows a preferred embodiment of the present invention. This preferred embodiment comprises a second level shifter 523 and a plurality of basic units. Each basic unit comprises a first level shifter 522 and an output buffer 524. And the connecting wires between the first level shifter 522 and the output buffer 524 are in parallel with two MOS, M1 and M2. Since the operating process of the basic unit has already been described in FIG. 6, the focus of the following description of the present embodiment will be on the circuit operation after XAO signal reaches.

Figure 1:
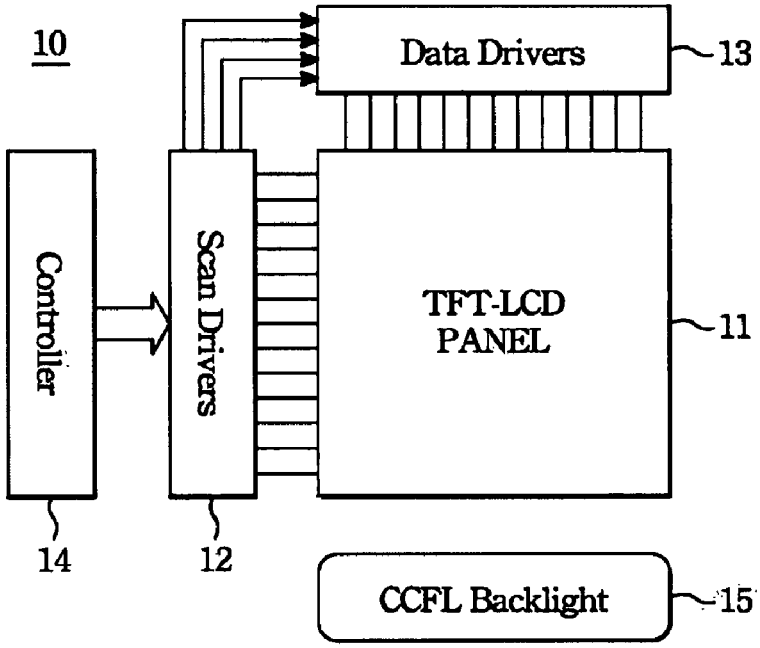
Fig. 1 (Prior Art)
FIG. 1 is a diagram of the structure of TFT-LCD display of the prior art.
Figure 2:
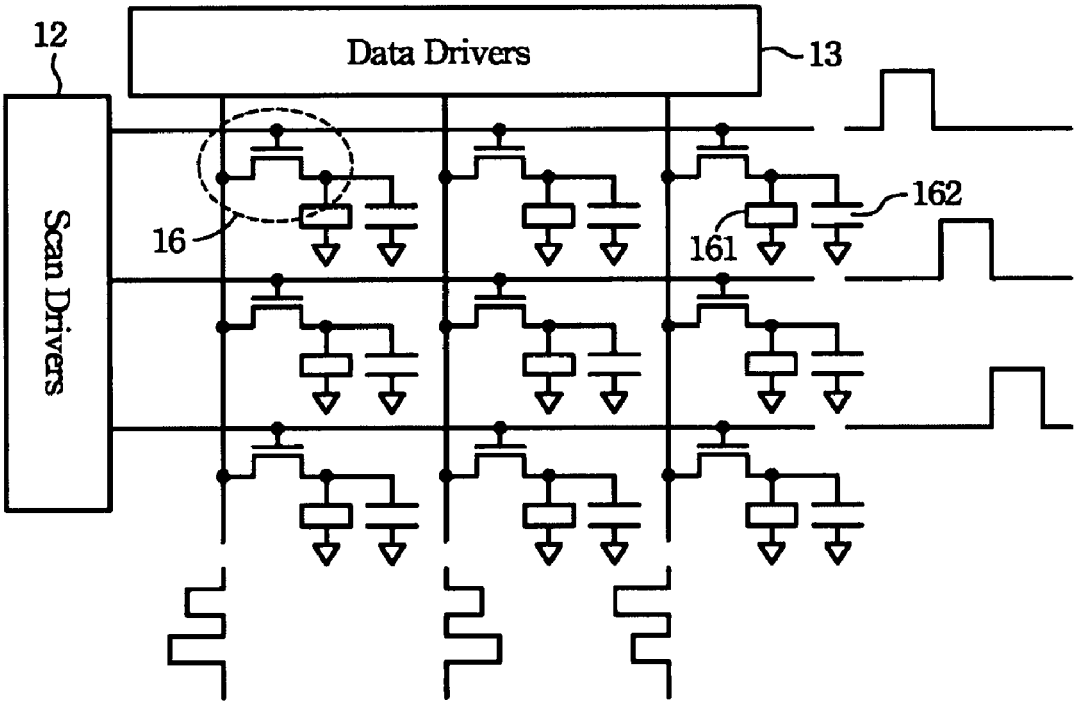
Fig. 2 (Prior Art)
FIG. 2 is an equivalent diagram of TFT-LCD panel of the prior art.
Figure 3:
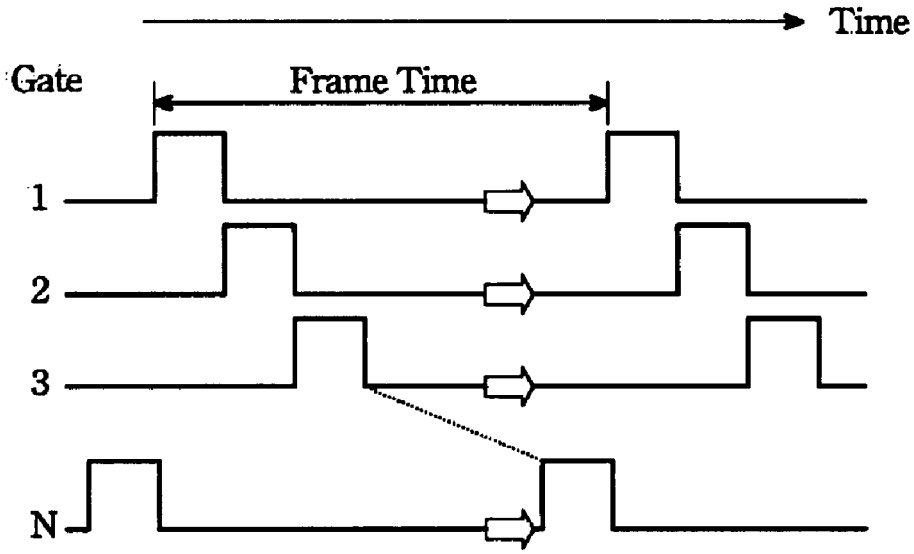
Fig.3 (Prior Art)
FIG. 3 is a diagram of the output signal of the gate driver of the prior art.
Figure 4:
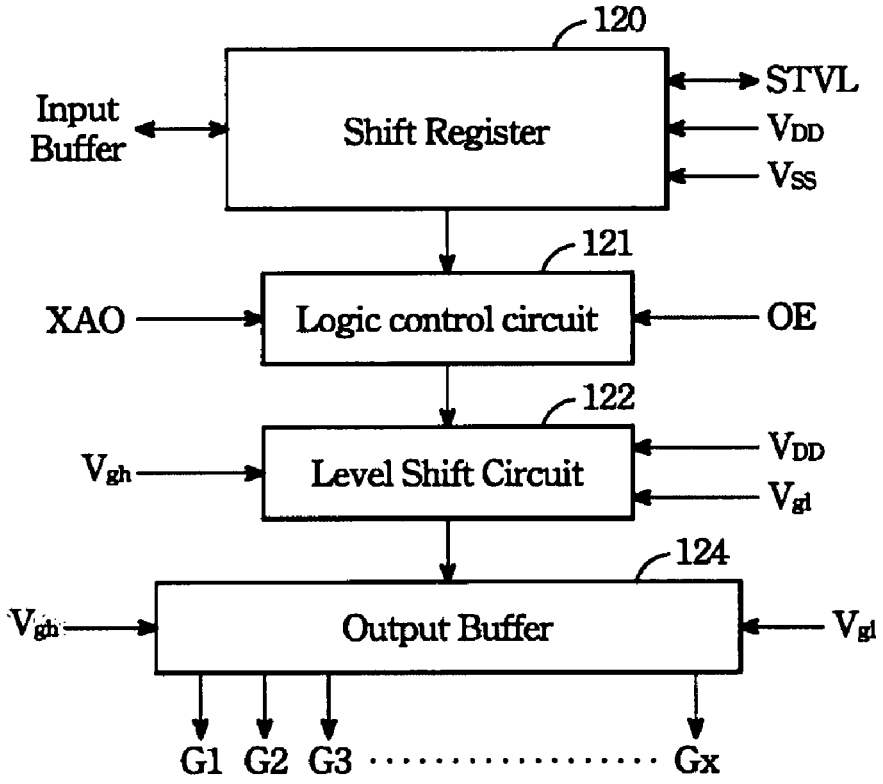
Fig.4 (Prior Art)
FIG. 4 is a structure diagram of the gate driver of the prior art.
Figure 8:
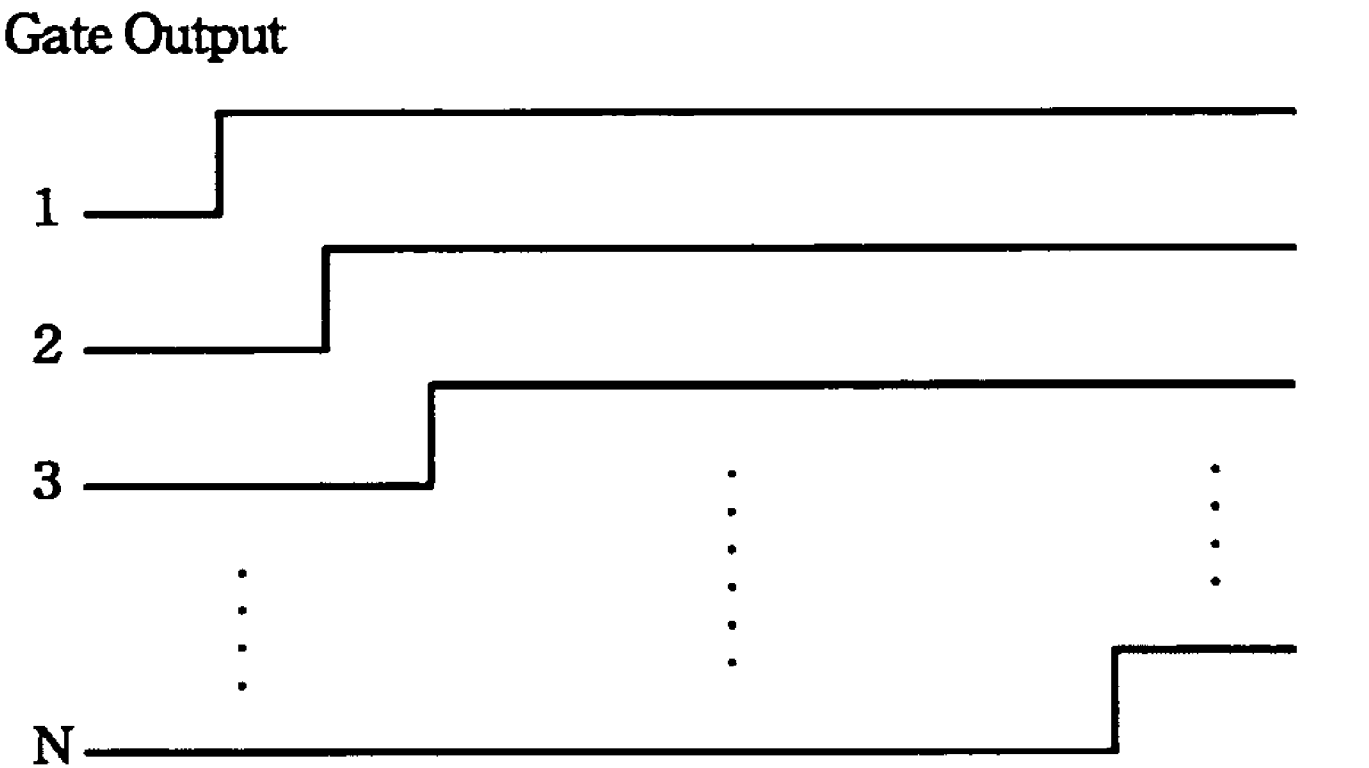
FIG. 8 is a diagram of the output signal of the gate driver circuit of the present invention.

First, when XAO is not activated, a plurality of output signals of output buffer 524 are a group of pulse signals arranged in order, as shown in FIG. 3. Then when XAO is activated, since XAO provides a low voltage signal that is transmitted through second level shifter 523 and is transferred to high voltage signal and also sends a signal that turns off the positive feedback loop of first level shifter 522, the output terminal of first level shifter 522 then becomes floating. At the instant that the output terminal of first level shifter 522 becomes floating, changes in the voltage and current of the output terminal of first level shifter 522 occur; for example, the voltage of the output terminal of first level shifter 522 can be kept to Vgh by parasitic capacitor or be kept to Vgl by parasitic capacitor. Moreover, the gate of MOS M2 in each unit is connected with the output terminal of second level shifter 523, and since the output of second level shifter 523 is a high voltage high level signal, MOS M2 is ready to turn on. Take the topmost unit for example. Since MOS M11 is connected with the output terminal of the previous cell, thus before the high voltage pulse of Pre_out signal reaches, even if MOS M21 is ready to be turned on. MOS M11 and M12 still cannot be turned on since MOS M11 is not turned on. Only when the high voltage pulse of Pre_out signal reaches can MOS M11 be turned on, which thus leads to the turning on of MOS M21 and pulls input voltage of output buffer 524 to Vgl. The output signal of output buffer 524 will then be pulled to Vgh. The output voltage signal of the first cell is then fed back to the gate of MOS M12 of the next cell (i.e. the second cell), which is shown in FIG. 7. MOS M12 will be turned on when the Pre_out high voltage signal reaches, and then MOS M22 is also turned on. Since both MOS M12 and M22 are turned on, the input voltage of output buffer 524 of the second cell will be pulled to Vgl, and the output voltage of output buffer 524 of the second cell will be pulled to Vgh. Obviously, there will be a time delay between the shift of output signal of the second cell to high voltage signal and the shift of output signal of the first cell to high voltage signal; this time delay is caused by feedback circuit. Similarly, when the output signal of the second cell of output buffer 524 is fed back to the nth cell, MOS Mln and Mtn will also be turned on, the input voltage of output buffer 524 of the nth cell will pulled to Vgl, and its output signal will pulled to Vgh. Similarly, there will also be a time delay between the shift of output signal of the nth cell to high voltage signal and the shift of output signal of the previous cell to high voltage signal. Accordingly, after output signals of the previous cell pulls to high voltage, all output signals of the next cell of output buffer 524 will pull to high voltage after a time delay. Thus each input signal of output buffer 524 pulls to high voltage in order, as shown in FIG. 8. It is obvious that in the gate driver circuit of the present invention, the problem of production of large current due to the pull to high voltage of all output signals of output buffer 524 at the same time that occurs when XAO is activated can be avoided. And since the shifting time between each output signal ranges from 10 μs to 10 ns, the defect of large current that may lead to burning of the trace can thus be eliminated. Moreover, in the process described above, the logic transfer of circuit is processed at high voltage, not from low voltage to high voltage. Therefore the possibility of failed conversion of level shifters 522 and 523 can also be eliminated. It should be noted that, the signal received by the first level cell can be set differently according to a specific requirement, for example, depending on when the circuit is required to operate. For example, the signal may be kept at a high voltage level so as to maintain the transistor in the first cell in the "on" state, or the signal may be turned high for a specific period of time. so that the transistor is "on" for that specific period of time.

Figure 9:
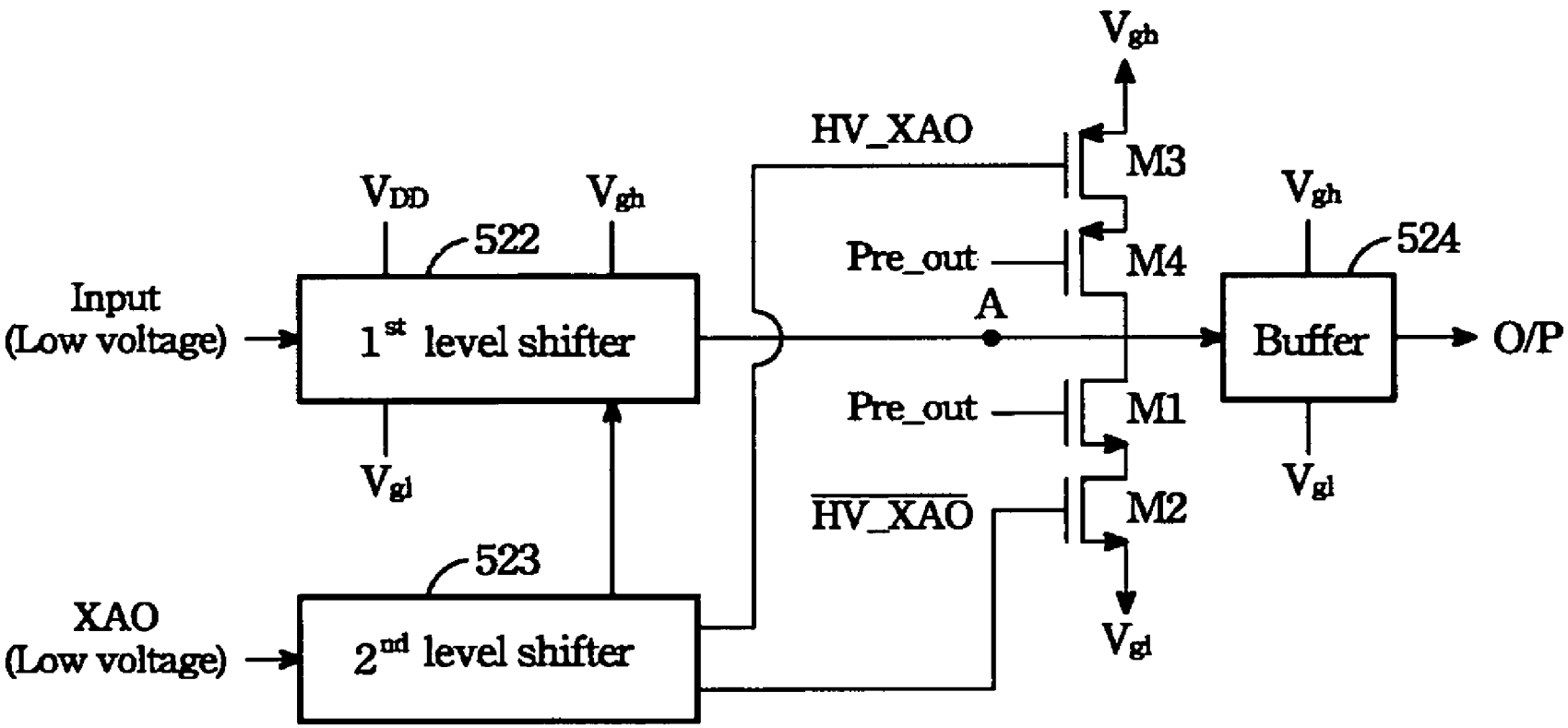
FIG. 9 is a diagram of another preferred embodiment of the gate driver circuit of the present invention.

The present invention further provides another gate driver circuit, which is shown in FIG. 9. FIG. 9 shows the basic unit of another embodiment of the gate driver circuit of the present invention. The way of circuit connection in the present embodiment is the same as that in FIG. 7. As shown in FIG. 9, the basic unit of the gate driver circuit of the present invention comprises a first level shifter 522, a second level shifter 523, an output buffer 524, and two CMOS composed of four MOS, M1, M2, M3, and M4, wherein the gate of CMOS composed of M1 and M4 is connected with the Pre_out signal, and the gate of CMOS composed of M2 and M3 is connected with HV_XAO and inverse HV_XAO signals; moreover, the second level shifter 523 is connected with the first level shifter 522. Obviously, the difference between FIG. 6 and FIG. 9 is that in FIG. 9 there are two more MOS, M3 and M4.

When XAO is activated, since XAO provides a low voltage signal that is transmitted through second level shifter 523 and is transferred to high voltage signal and also sends a signal that turns off the positive feedback loop of first level shifter 522, the output terminal of first level shifter 522 becomes floating. At the instant that the output terminal of first level shifter 522 becomes floating, changes in the voltage and current of the output terminal of first level shifter 522 occur. At this time, the gates of MOS M2 and MOS M3 are connected with Vgh (i.e. inverse HV_XAO) and Vgl (i.e. HV_XAO) of second level shifter 523 respectively, and therefore both MOS M2 and M3 are then ready to be turned on and the gates of MOS M1 and MOS M4 are connected with the Pre_out signal of output buffer 524. Thus when the output signal of output buffer 524 of the previous cell is Vgl, MOS M3 and M4 will be turned on, and MOS M1 will not be turned on, and therefore MOS M2 will not be turned on. Point A in FIG. 9 will become a Vgh signal due to the turning on of MOS M3 and M4. Obviously, point A is no longer in a floating condition; in other words, the voltage signal of point A is determined by whether MOS M3 and M4 are turned on or not. Thus, when M3 and M4 are turned on and point A is kept to high voltage, the output signal of output buffer 524 can be kept as Vgl signal. When the high voltage pulse of the nth output signal reaches, MOS M4 will be turned off, which then leads to the turning on of MOS M1 and M2 and the pulling of the voltage of point A to Vgl. In other words, the low voltage signal of point A is determined by whether MOS M1 and M2 are turned on, which also determines whether the output signal of output buffer 524 transfers to Vgh or not. It is thus clear that the voltage signal of point A is determined by the on/off status of four MOS, M1, M2, M3, and M4, which thus avoids the floating condition of the output terminal of first level shifter 522 that occurs when XAO is activated. It is also clear that after replacing the basic unit in FIG. 7 with the basic unit in the present embodiment, the output signal of the next cell of output buffer 524 is pulled to Vgh after a time delay after the Pre_out signal is pulled to Vgh. Thus each input signal of output buffer 524 is pulled to high voltage in order, as shown in FIG. 8. Therefore, in the gate driver circuit of the present invention, the problem of production of large current due to the shift to high voltage of all output signals of output buffer 524 at the same time that occurs when XAO is activated can be avoided. And since the shifting time between each output signal ranges from 10 μs to 10 ns, the defect of large current that may lead to burning of the trace can thus be eliminated. Moreover, in the process described above, the logic transfer of circuit is processed at high voltage, not from low voltage to high voltage. Therefore the possibility of failed conversion of level shifters 522 and 523 can also be eliminated.

In all gate driver circuits of the present invention described above, all the output buffers 524 are inverters. When the inverter processes signal conversion, there will be a short instant in which PMOS and NMOS are both turned on and a transient current occurs. When the gate driver circuit is driven in the condition of high voltage, high speed, and large current, this transient current will exhaust a large amount of power. In order to avoid the occurrence of this kind of transient current in the gate driver circuit of the present invention, a gate driver circuit with compensating circuit is further disclosed.

Figure 10:
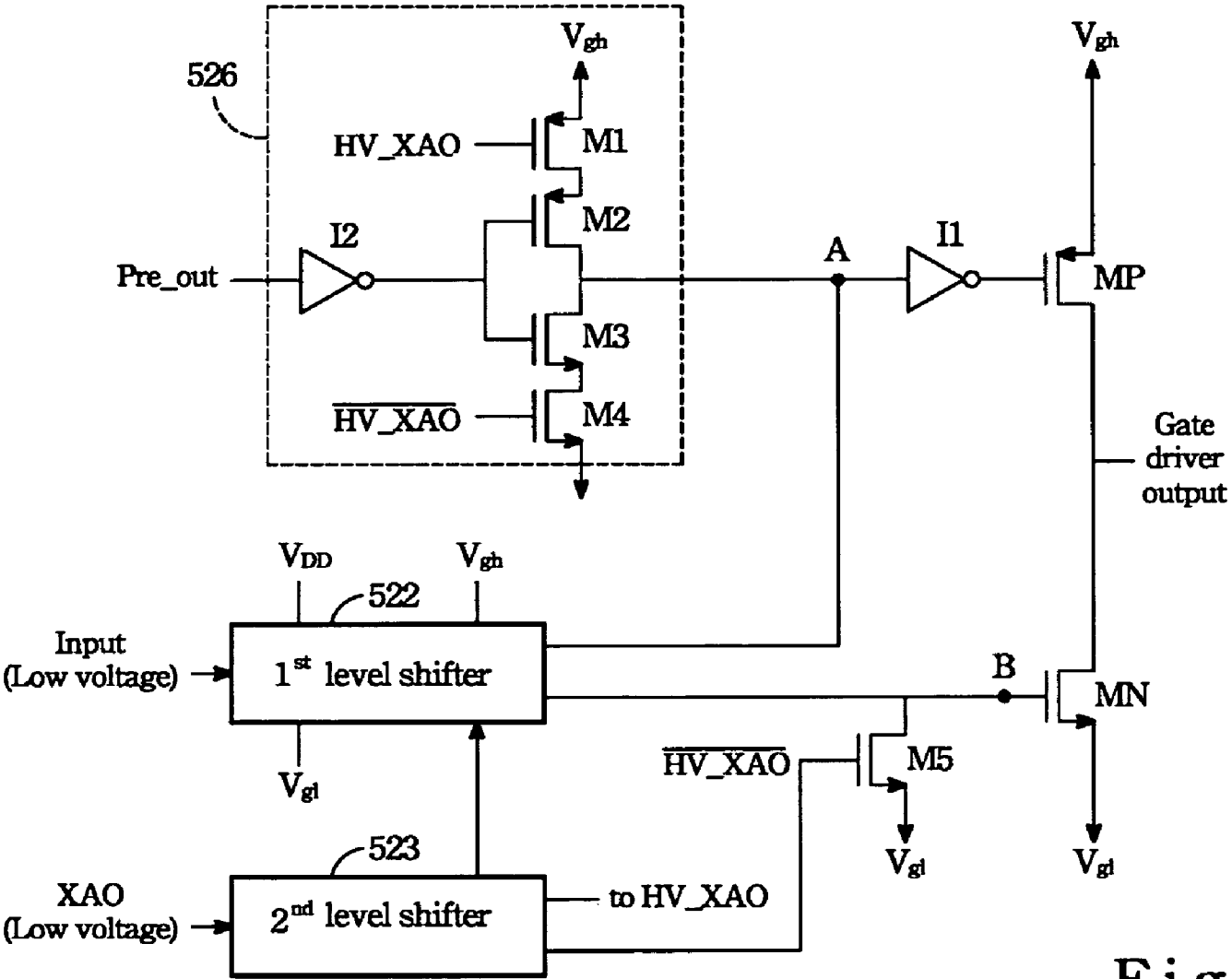
FIG. 10 is a diagram of still another preferred embodiment of the gate driver circuit of the present invention.
Figure 11:
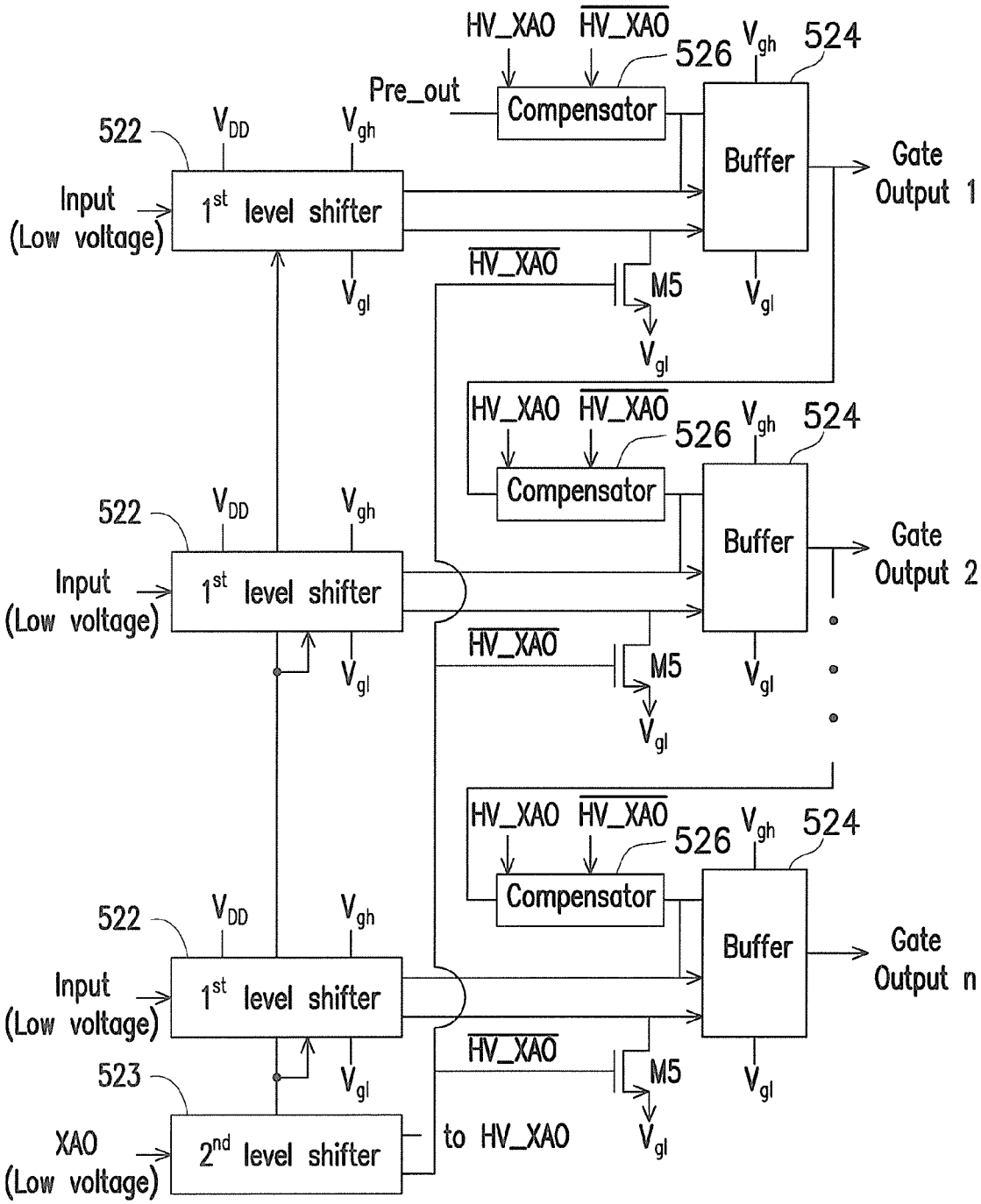
FIG. 11 is a diagram of a preferred embodiment of the gate driver circuit of the present invention utilizing the gate driver circuit of FIG. 10.

Please refer to FIG. 10, in which is the basic unit of another embodiment of the gate driver circuit with compensating circuit of the present invention. The way of circuit connection in the present embodiment is the same as that in FIG. 7, and as shown in FIG. 11, a diagram of a preferred embodiment of the gate driver circuit of the present invention utilizing the gate driver circuit of FIG. 10, and the detailed descriptions for FIG. 11 can be readily analogized from those for FIG. 7, thus omitted here for brevity. As shown in FIG. 10, the basic unit of the gate driver circuit of the present embodiment comprises a first level shifter 522, a second level shifter 523, and an output buffer composed of a PMOS, MP, and an NMOS, MN daisy-chained together, wherein the gate of each PMOS MP is connected with the output terminal of an inverter II and the input terminal of the inverter 11 is connected with the output terminal of a compensating circuit 526. The input terminal of inverter 11 is connected with one terminal of first level shifter 522, one positive output terminal for example. The gate of each NMOS MN is connected with another terminal of first level shifter 522 and another NMOS, M5. The gate of MOS M5 is connected with inverse HV_XAO. The compensating circuit 526 described above is composed of a pair of CMOS (M1, M2, M3, and M4), wherein the gates of two MOS (M2 and M3 for example) are connected with the output terminal of another inverter 12, and the input terminal of this inverter 12 is connected with the Pre_out signal. In addition, the gate of PMOS (M1) of another CMOS of the compensating circuit 256 is connected with HV XAO, and the gate of NMOS (M4) is connected with inverse HV XAO.

When XAO is activated, since XAO provides a low voltage signal that is transmitted through second level shifter 523 and is transferred to high voltage signal and also sends a signal that turns off the positive feedback loop of first level shifter 522, the output terminal of first level shifter 522 becomes floating. At the instant that the output terminal of first level shifter 522 becomes floating, changes in the voltage and current of the output terminal of first level shifter 522 occur. At this time, the gate of MOS M5 is connected with inverse HV_XAO, and therefore MOS M5 will be turned on and the voltage of Point B will be pulled to Vgl, which causes the MOS MN in the output buffer to turn off. In addition, before the pulse of the Pre_out signal reaches the inverter I2 in the compensating circuit 526 (i.e. not yet shifted to high voltage), the MOS M2 in the compensating circuit 256 is turned off and the MOS M1, M3, and M4 are turned on. Thus the voltage of Point A is kept to Vgl, and the MOS MP in the output buffer is also turned off. The voltage of Point A does not pull to Vgh until the high voltage pulse of Pre_out signal reaches, the MOS M3 in compensating circuit 526 is turned off, and MOS M1, M2, and M4 are turned on. The voltage of Point A can be pulled to Vgl after being transmitted through the inverter I1. Thus the MOS MP will then be turned on and send an output signal of Vgh.

Obviously, after replacing the basic unit in FIG. 7 with the basic unit in the present embodiment as shown in FIG. 11, the output result of the circuit of the present embodiment will be the same as that of the above-mentioned circuit. In other words, when the Pre_out signal is shifted to high voltage, the output signal of the next cell of the output buffer is shifted to high voltage after a time delay and thus each input signal of the output buffer is shifted to high voltage in order. Therefore the large current that occurs when all output signals of output buffer are shifted to high voltage at the same time when XAO is activated can be avoided. In the present embodiment, since the shifting time between each output signal ranges from 10 is to 10 ns, the defect of large current that may lead to burning of the trace can thus be eliminated. Moreover, in the process described above, the logic transfer of circuit is processed at high voltage, not from low voltage to high voltage. Therefore the possibility of failed conversion of level shifters 522 and 523 can also be eliminated. Furthermore, since the gates of MOS MP and MN in output buffer are controlled respectively by two output terminals of first level shifter 522, MOS MN can be turned on in advance when the output buffer outputs driving signal and the leak between MOS MP to MOS MN can thus be reduced.

Concerning the embodiments described above, it is clear that many modifications can be made to the present invention. Therefore it is necessary to make clear that in addition to the embodiments described in detail above, the present invention can also be applied expansively in other embodiments within the scope of what is claimed. What are described above are only preferred embodiments of the present invention and should not be used to limit the claims of the present invention; equivalent changes or modifications made without departing from the spirit disclosed by the present invention should still be included in the appended claims.

What is claimed is:

1. A gate driver circuit for an LCD display, comprising:

a plurality of first level shifters;

a plurality of output buffers, each having an input terminal coupled to an output terminal of a corresponding one of said first level shifters; and a second level shifter, configured to convert an XAO signal indicating whether the LCD display operates in a display-off mode, and;

a plurality of MOS transistor sets, each configured to control a voltage at the input terminal of a corresponding one of the output buffers based on a voltage at the output terminal of a preceding one of the output buffers and a voltage at a first output terminal of the second level shifter.

2. The gate driver circuit as claimed in claim 1, wherein each of the MOS transistor sets comprises a first MOS transistor and a second MOS transistor coupled in series, wherein the first MOS transistor has a gate coupled to the output terminal of the preceding one of the output buffers, and the second MOS transistor has a gate coupled to the first output terminal of the second level shifter.

3. The gate driver circuit as claimed in claim 2, wherein each of the MOS transistor sets is coupled to control the voltage at the input terminal of the corresponding one of the output buffers further based on a voltage at a second output terminal of the second level shifter.

4. The gate driver circuit as claimed in claim 3, wherein each of the MOS transistor sets further comprises a third MOS transistor and a fourth MOS transistor coupled in series, wherein the third MOS transistor has a gate coupled to the second output terminal of the second level shifter, and the fourth MOS transistor has a gate coupled to the output terminal of the preceding one of the output buffers.

5. The gate driver circuit as claimed in claim 1, wherein the second level shifter is further coupled to each of the first level shifters and configured to turn off a positive feedback loop of each of the first level shifters when the XAO signal indicates the LCD display operates in the display-off mode.

6. The gate driver circuit as claimed in claim 1, wherein the second level shifter is configured to convert a level of the XAO signal to a higher level.

7. An LCD display, comprising an LCD panel and a gate driver as claimed in claim 1 to drive the LCD panel.

8. A gate driver circuit for an LCD display, comprising:

a plurality of first level shifters;

a plurality of output buffers, each having a first input terminal and a second input terminal respectively coupled to a first output terminal and a second output terminal of a corresponding one of the first level shifters;

a second level shifter configured to convert an XAO signal indicating whether the LCD display operates in a display-off mode;

a plurality of compensating circuits, each configured to control a voltage at the first input terminal of a corresponding one of the output buffers based on a voltage at an output terminal of a preceding one of the output buffers and voltages at a first output terminal and a second output terminal of the second level shifter; and a plurality of MOS transistors, each coupled to control a voltage at the second input terminal of a corresponding one of the output buffers based on the voltage at the second output terminal of the second level shifter.

9. The gate driver circuit as claimed in claim 8, wherein each of the output buffers comprises a first-type MOS transistor and a second-type MOS transistor coupled in series, wherein a gate of the first-type MOS transistor is coupled to a corresponding one of the compensating circuits via an inverter, and the second-type MOS transistor is coupled to a corresponding one of the MOS transistors and a corresponding one of the first level shifters.

10. The gate driver circuit as claimed in claim 8, wherein each of the compensating circuits comprises:

a first MOS transistor and a second MOS transistor of a first type;

a third MOS transistor and a fourth MOS transistor of a second type; and an inverter, wherein the first MOS transistor has a gate coupled to the first output terminal of the second level shifter, the fourth MOS transistor has a gate coupled to the second output terminal of the second level shifter, and the second and third MOS transistors have gates coupled via the inverter to the output terminal of the preceding one of the output buffers.

11. The gate driver circuit as claimed in claim 8, wherein the second level shifter is further coupled to each of the first level shifters and configured to turn off a positive feedback loop of each of the first level shifters when the XAO signal indicates the LCD display operates in the display-off mode.

12. The gate driver circuit as claimed in claim 8, wherein the second level shifter is configured to convert a level of the XAO signal to a higher level.

13. An LCD display, comprising an LCD panel and a gate driver as claimed in claim 8 to drive the LCD panel.

* * * * *